United States Patent [19]

Hanyu et al.

[11] 4,278,039

[45] Jul. 14, 1981

[54] DETACHABLE PRESSER FOOT

[75] Inventors: Susumu Hanyu, Hachioji; Akio Koide, Kokubunji, both of Japan

[73] Assignee: Janome Sewing Machine Industry Co., Japan

[21] Appl. No.: 64,980

[22] Filed: Aug. 9, 1979

[30] Foreign Application Priority Data

Aug. 11, 1978 [JP] Japan ..... 53/109551[U]

[51] Int. Cl.[3] ..... D05B 29/12

[52] U.S. Cl. ..... 112/240

[58] Field of Search ..... 112/235, 240

[56] References Cited

U.S. PATENT DOCUMENTS

| | | | |
|---|---|---|---|
| 3,326,160 | 6/1967 | Murino | 112/240 |
| 3,511,201 | 5/1970 | Howell | 112/240 |
| 3,716,008 | 2/1973 | Howell | 112/240 |
| 3,726,243 | 4/1973 | Howell | 112/235 |
| 3,854,433 | 12/1974 | Hanyu | 112/240 X |
| 3,875,882 | 4/1975 | Schorb | 112/235 |
| 4,010,701 | 3/1977 | Helfont | 112/235 X |

FOREIGN PATENT DOCUMENTS 155610 10/1904 Fed. Rep. of Germany ..... 112/235

*Primary Examiner*—Werner H. Schroeder
*Assistant Examiner*—Andrew M. Falik
*Attorney, Agent, or Firm*—William A. Drucker

[57] ABSTRACT

The presser foot for a sewing machine is provided with a pair of aligned rollers arranged near the needle dropping hole. The lower end portion of the presser foot holder is connected to the presser foot between the pair of aligned rollers, so that a sufficient downwardly pressing force may be applied on the sewn materials even in the region near the needle dropping hole.

3 Claims, 6 Drawing Figures

DETACHABLE PRESSER FOOT

BACKGROUND OF INVENTION

This invention relates to a presser foot of a sewing machine which is provided with rollers applying a sufficient pressure on the sewn material.

Hitherto, a presser foot made of Teflon for example or a roller presser foot has been utilized to sew up leatherette or vinyl-leatherette materials in order to decrease friction with the presser foot and prevent relative displacement of materials to be sewn up. The presser foot made of Teflon for example is, however, inadvantageous from an economical viewpoint since it is considered expendable in spite of its high price due to its low wearability. On the other hand, as to the roller presser foot, sewing problems such as skipped stitches, thread-damaging and thread-cutting occur since the rollers are not arranged near the needle dropping hole and accordingly any pressing force applied on materials to be sewn around the needle dropping hole becomes insufficient. Such problems can be often caused on the absence of a sufficient pressure on the sewn material near the needle dropping hole, because the sewn material in such a region may float with the vertically reciprocating needle and therefore a proper thread loop is not formed, and the loop taking hook fails to catch it or damages or cuts the thread loop which is insufficient.

SUMMARY OF INVENTION

Accordingly, the object of the invention is to provide a presser foot of a sewing machine having rollers which are effective even in the region near the needle dropping hole and capable of effectively applying the pressing force on the materials to be sewn up around the needle dropping hole.

According to this invention, the presser foot is used in combination with a sewing machine having a presser bar axially displaceable relative to the needle plate and a presser foot holder affixed to the lower end of the presser bar, said presser foot substantially comprising a needle dropping hole; a plurality of rollers each arranged in the direction crossing the material feeding direction and each partly protruded out of the sole of the presser foot; a central part detachably engaged by the presser foot holder; a pair of aligned rollers arranged therein adjacent the needle dropping hole thereof, the central part being arranged between said pair of aligned rollers.

BRIEF DESCRIPTION OF DRAWINGS

Further objects and advantages of the invention can be more fully understood from the following detailed description in reference to the accompanying drawings in which.

DESCRIPTION OF PREFERRED EMBODIMENTS

Figure 1:
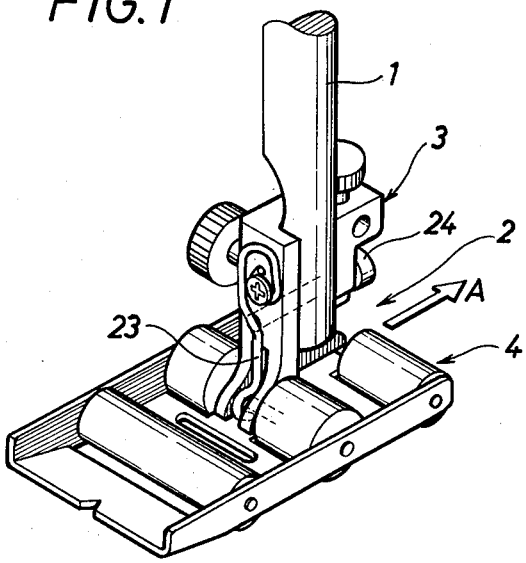
FIG. 1 is a perspective view showing one embodiment of this invention affixed to a presser foot holder on the presser bar of a sewing machine.
Figure 2:
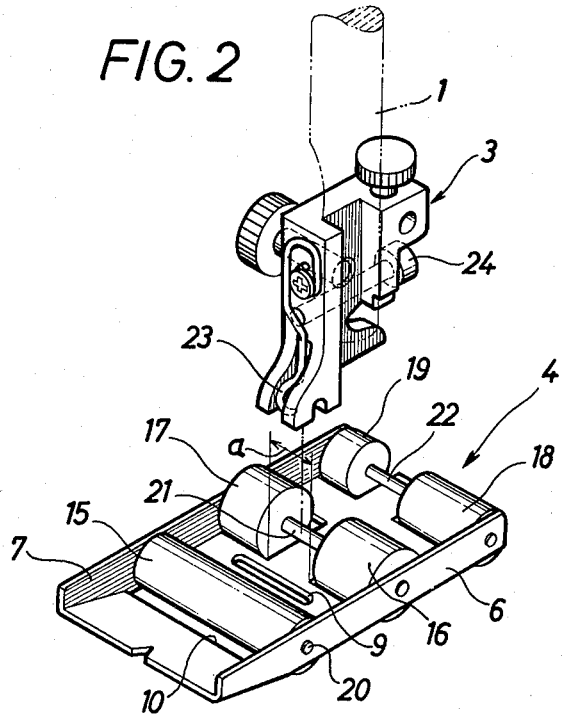
FIG. 2 is a perspective view showing the embodiment detached from the presser foot holder.
Figure 3:
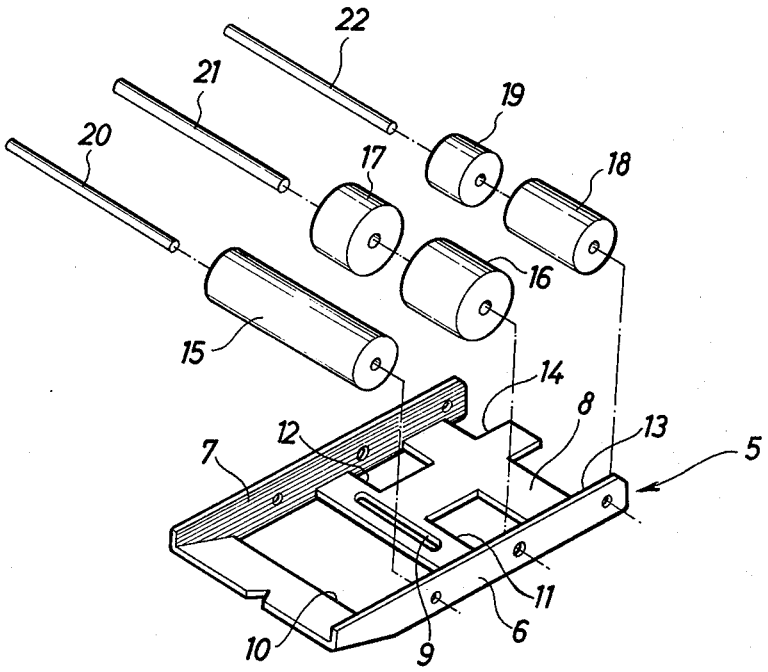
FIG. 3 is an exploded perspective view of the presser foot of the embodiment shown in FIG. 1.

A preferred embodiment of this invention shown in FIGS. 1–3 comprises a presser bar 1 vertically or axially displaceable relative to a needle plate (not shown), a roller presser foot 2 comprising a presser foot holder 3 mounted on the lower end of said presser bar 1 and a presser foot sole 4 detachably connected to the lower end of said presser foot holder 3. A roller carrying frame 5 of said presser foot sole 4 consists of opposed vertical walls 6, 7 and a bottom wall 8 interconnecting said vertical walls. A slot-shaped needle dropping hole 9 is formed substantially in the center of said bottom wall 8 transverse to the material feeding direction A.

A rectangular opening 10 for receiving a first roller 15 is arranged adjacent said needle dropping hole 9 on one side thereof. A pair of spaced and aligned openings 11, 12 for receiving second and third rollers 16, 17 are arranged near the needle dropping hole 9 on the opposite side of said hole 9. Adjacent said openings 11, 12, another pair of spaced and aligned cutouts 13, 14 for fourth and fifth rollers 18, 19 are provided on the one end of the bottom wall as shown. These rollers are rotatably supported on transverse pins 20, 21, 22 respectively which are arranged between the two vertical walls 6, 7. These rollers are prevented from the movement in the axial direction and each slightly protruded out of said bottom wall 8.

The lower end of said presser foot holder 3 is positioned between said second and third rollers 16, 17 mounted near said needle dropping hole 9. The distance a between the ends of the second and third rollers 16, 17 is set to be almost the same as the lateral width of the lower end of said presser foot holder 3 which is forked and vertically grooved as shown. A well-known spring 23 is installed in the vertical groove of said presser foot holder 3. The spring has a hook shaped portion at the lower end thereof, which resiliently engages the supporting pin 21 between the two rollers 16, 17, if the presser foot 4 is pushed up. The reference numeral 24 is a push button member which is manually pushed to disengage the spring hook 23 from the pin 21. Another pin may be provided in parallel relationship with the pin 21 between the aligned rollers 16, 17 in a position closer to the needle dropping hole 9, so that the presser foot may be connected to the presser foot holder by means of the pin. In this case, the fourth and fifth rollers 18, 19 may be eliminated.

Figure 4:
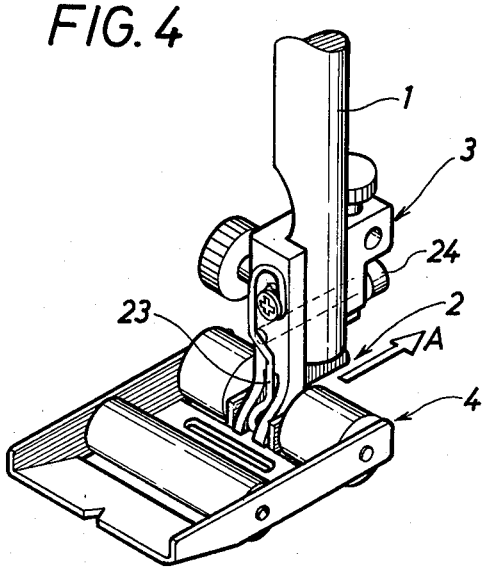
FIG. 4 is a perspective view showing a modified embodiment of this invention affixed to a presser foot holder on the presser bar of the sewing machine.
Figure 5:
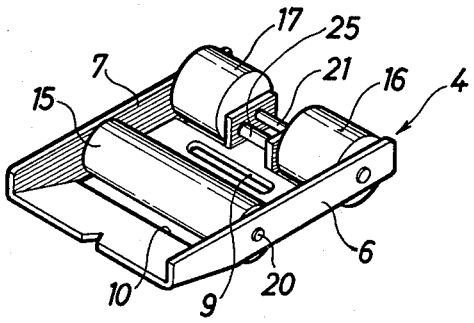
FIG. 5 is a perspective view of the presser foot of the modified embodiment detached from the presser foot holder.
Figure 6:
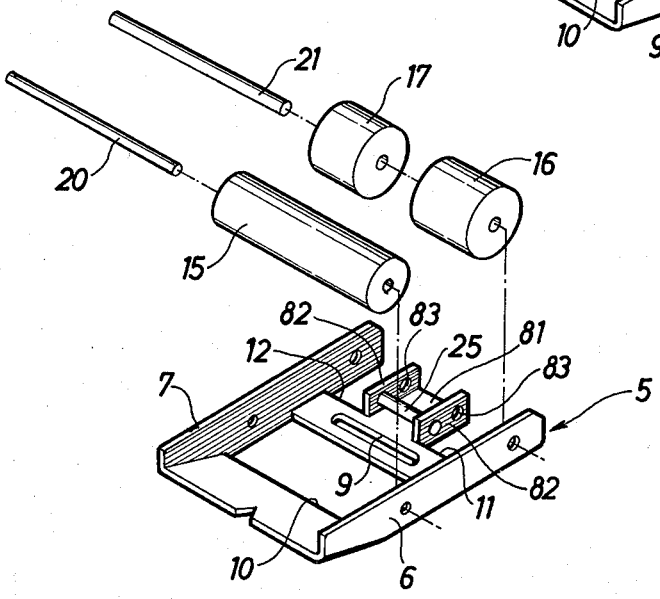
FIG. 6 is an exploded perspective view of the presser foot shown in FIG. 5.

FIGS. 4–6 show a modified embodiment of this invention. In this embodiment, the bottom wall 8 of the roller mounting frame 5 is T-shaped and both sides of the leg portion of said T are bent up to form central spaced walls 82, 82 with the distance being the same as the lateral width at the lower end part of the holder 3. Between said walls, a bar 25 is mounted to be engaged by said hook-shaped portion of the spring 23. The walls 82, 82 have holes 83, 83 respectively provided at the end side thereof for additionally supporting the pin 21. In the embodiment shown in FIGS. 1–3, the usage of the fourth and fifth rollers 18, 19 is unavoidable to effectively convert the pressing force to the first roller 15 since the hook-shaped portion of the lower end of the presser foot holder 3 engages the supporting pin 21 for the second and third rollers 16, 17. In the modified embodiment shown in FIGS. 4–6, however, said fourth and fifth rollers 18, 19 are unnecessary since the presser foot holder 3 is connected not to the supporting pin 21 but to the bar 25 separately mounted between the central walls 82, 82.

In accordance with this invention as hereinabove explained, a downwardly pressing force is effectively applied on the materials to be sewn in the region near and around the needle dropping hole 9 by said pair of rollers 16, 17 so that sewing problems such as skipped stitches, thread-damaging and thread-cutting can be completely prevented since the relative displacement of materials to be sewn up does not occur.

What is claimed is:

1. A presser foot, for use in combination with a sewing machine having a presser bar axially displaceable relative to a needle plate, and a presser foot holder secured to a lower end of the presser bar, said presser foot comprising:

(i) a frame including a needle dropping hole and a plurality of apertures to receive rollers (ii) a plurality of rollers journalled on said frame for rotation about respective axes which are transverse to the direction of feed of material past the presser foot when in use, said rollers protruding through the frame apertures, said plurality of rollers including a pair of rollers which are coaxial and which are closely adjacent to the needle hole in the direction of feed of material, said pair of rollers being spaced axially from each other, (iii) connection means on said frame disposed between said spaced rollers for detachable engagement with the presser foot holder.

2. A presser foot, as claimed in claim 1, wherein said spaced rollers are mounted on a common axial pin on said frame, a portion of said pin between said rollers constituting said connection means.

3. A presser foot, as claimed in claim 1, wherein said frame includes two walls spaced axially of the spaced rollers and disposed between said rollers, said connection means comprising a bar mounted on said walls.

* * * * *